United States Patent [19]

Harrod

[11] Patent Number: 5,031,942

[45] Date of Patent: Jul. 16, 1991

[54] DOOR LATCH MECHANISM

[75] Inventor: Lawrence R. Harrod, Fort Wayne, Ind.

[73] Assignee: Kransco, San Francisco, Calif.

[21] Appl. No.: 476,956

[22] Filed: Feb. 8, 1990

[51] Int. Cl.[5] ..... E05C 1/16; E05C 3/10

[52] U.S. Cl. ..... 292/224; 292/170; 292/DIG. 51; 292/DIG. 53

[58] Field of Search ..... 292/224, 170, 98, 197, 292/174, 173, DIG. 53, DIG. 51

[56] References Cited

U.S. PATENT DOCUMENTS

| | | | |
|---|---|---|---|
| 278,323 | 5/1883 | Elliott | 292/170 |
| 1,074,340 | 9/1913 | Altmann | 292/170 X |
| 1,111,235 | 9/1914 | Redin | 292/170 |
| 1,270,288 | 6/1918 | Gruber | 292/170 |
| 1,279,353 | 9/1918 | Kelly | 292/224 X |
| 2,411,098 | 11/1946 | Leiss | 292/170 X |

FOREIGN PATENT DOCUMENTS

| | | | |
|---|---|---|---|
| 149107 | 8/1920 | United Kingdom | 292/170 |

*Primary Examiner*—Richard E. Moore

*Attorney, Agent, or Firm*—Kolisch, Hartwell, Dickinson, McCormack & Heuser

[57] ABSTRACT

A latch mechanism including a panel with structure on the panel movably mounting a trigger element and a striker element. The striker element is biased by a spring to an extended position where a latching end portion in the striker element extends beyond the panel. A cam in the trigger element engages a follower on the striker element to shift the striker element to a retracted position with movement of the trigger element.

9 Claims, 4 Drawing Sheets

DOOR LATCH MECHANISM

This invention relates a to latch mechanism, and more particularly to a latch mechanism having a simple and reliable construction which may conveniently be made with a minimum number of parts. Features of the latch mechanism contemplated make it particularly suitable for incorporation with the doors of toys such as toy vehicles, since parts in the mechanism may conveniently be prepared as molded plastic articles and without the requirement of machining being performed. By indicating usefulness with toy vehicles, however, it is not intended thereby to limit the uses of the latch mechanism.

A general object of the invention, therefore, is to provide a latch mechanism of simple but reliable construction which may conveniently be made for the most part of molded plastic parts.

Another object is to provide a latch mechanism which includes a trigger element and a striker element, both movably mounted on a panel, so organized that one element retains the other element in place. A related object is to provide such a latch mechanism wherein the one element which is performing the retaining function is retained on the panel through a post projecting from the panel and a retainer element engaging the one element and mounted on the post.

In particular embodiments of the invention herein disclosed, the trigger element in the latch mechanism is mounted for vertical movement between a lowered advanced position and a raised return position. Guide structure on the panel which encloses the latch mechanism supports the trigger element for movement between these two positions. A striker element extending transversely of the trigger element and engaged by a cam portion on the trigger element is shifted between extended and retracted positions by movement of the trigger element between returned and advanced positions.

These and other objects and advantages are attained by the invention, which is described hereinbelow in conjunction with the accompanying drawings, wherein.

Figure 2:
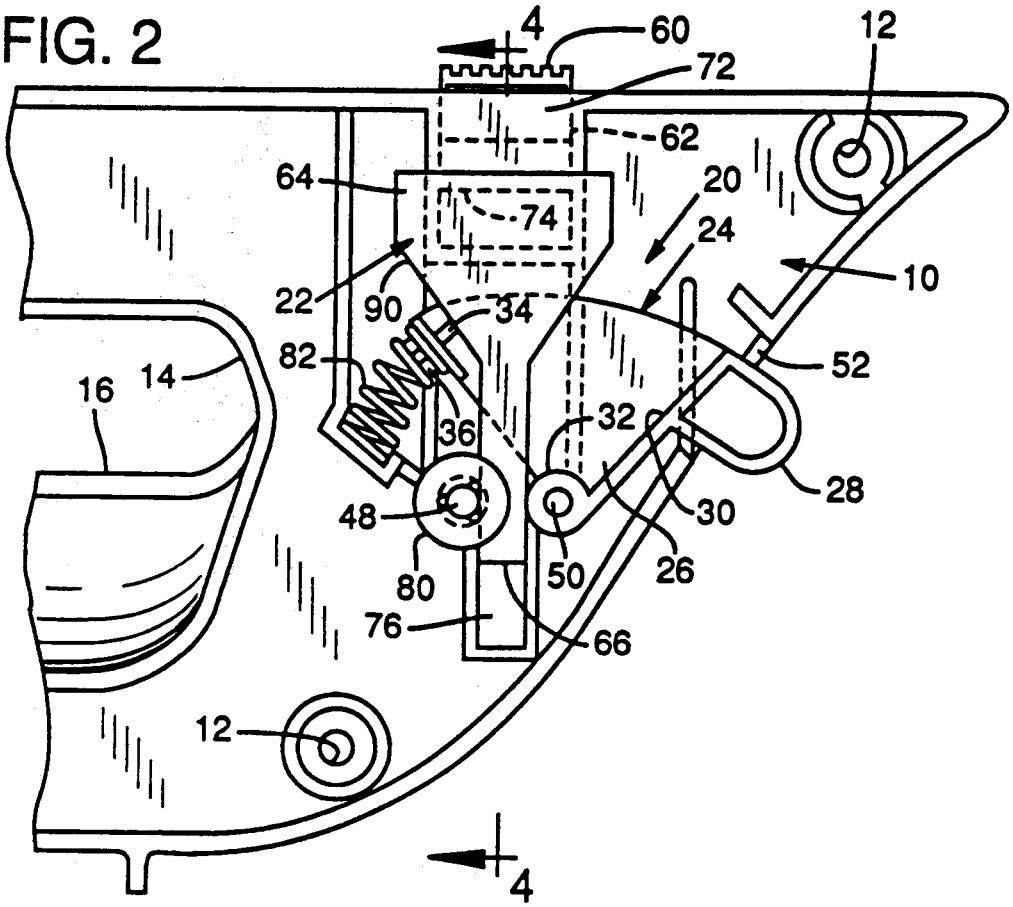
FIG. 2 is view illustrating the opposite or outwardly facing side of the door panel shown in FIG. 1, and also showing the operating parts of a latch mechanism which is supported on the door panel.
Figure 4:
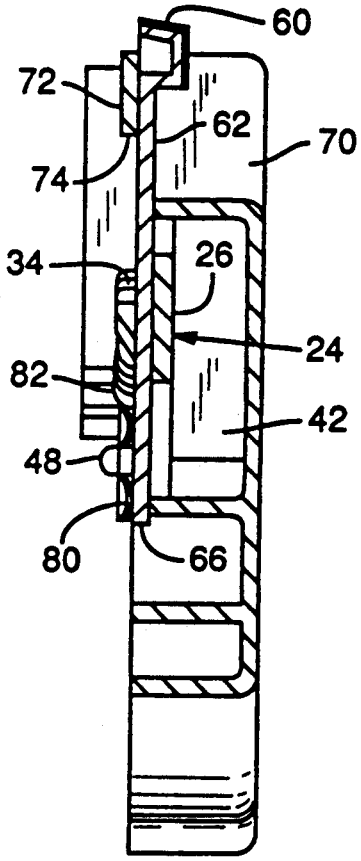
FIG. 4 is a cross-sectional view taken generally along the line 4—4 in FIG. 2.
Figure 5:
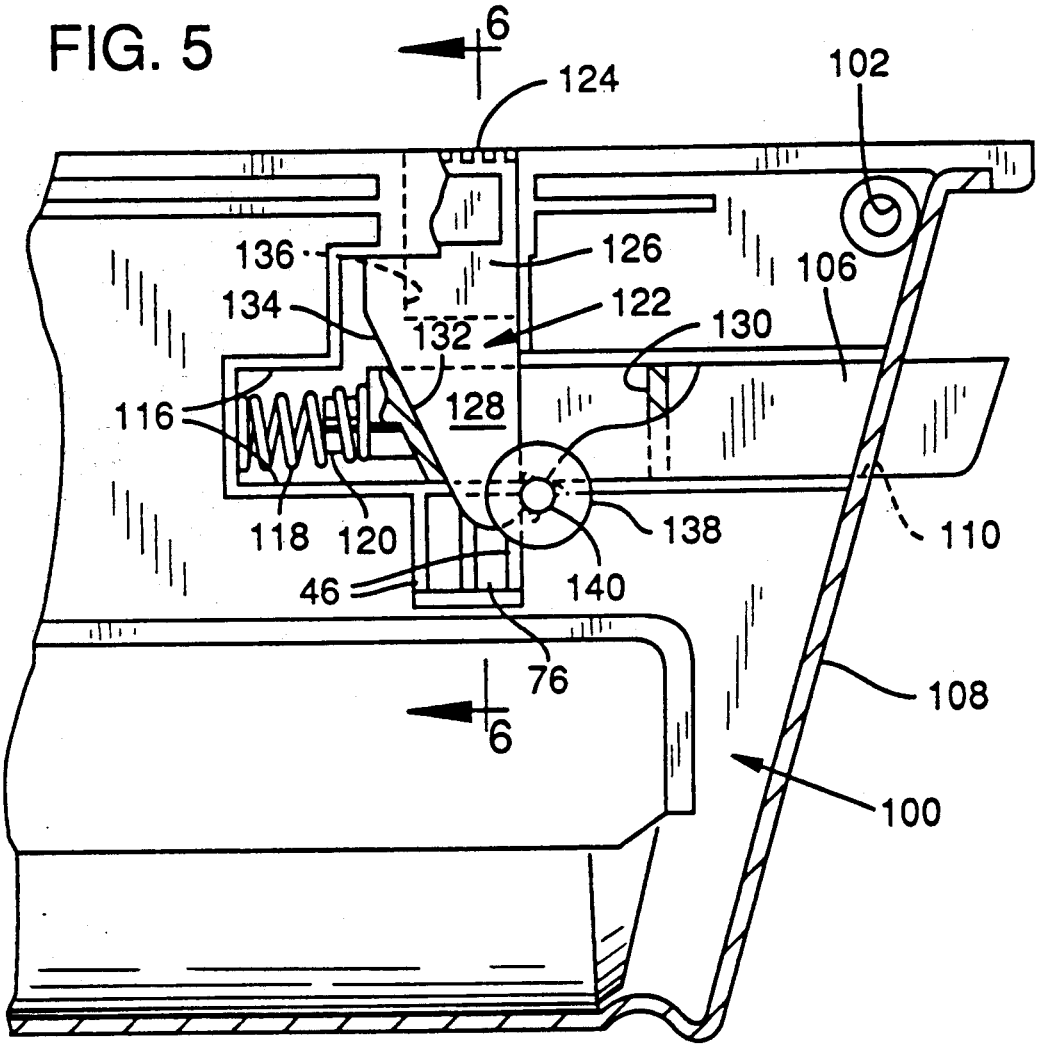
Figure 6:
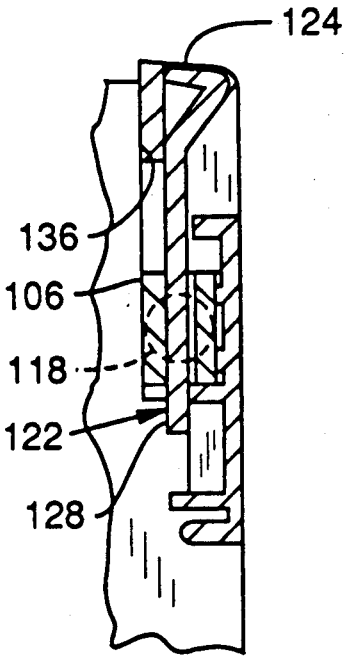

FIG. 5, as does FIG. 2, shows the outwardly facing side of the inner panel of a toy vehicle door with a modified form of latch mechanism mounted thereon;

FIG. 6 is a cross-sectional view taken along the line 6—6 in FIG. 5; and

Figure 7:
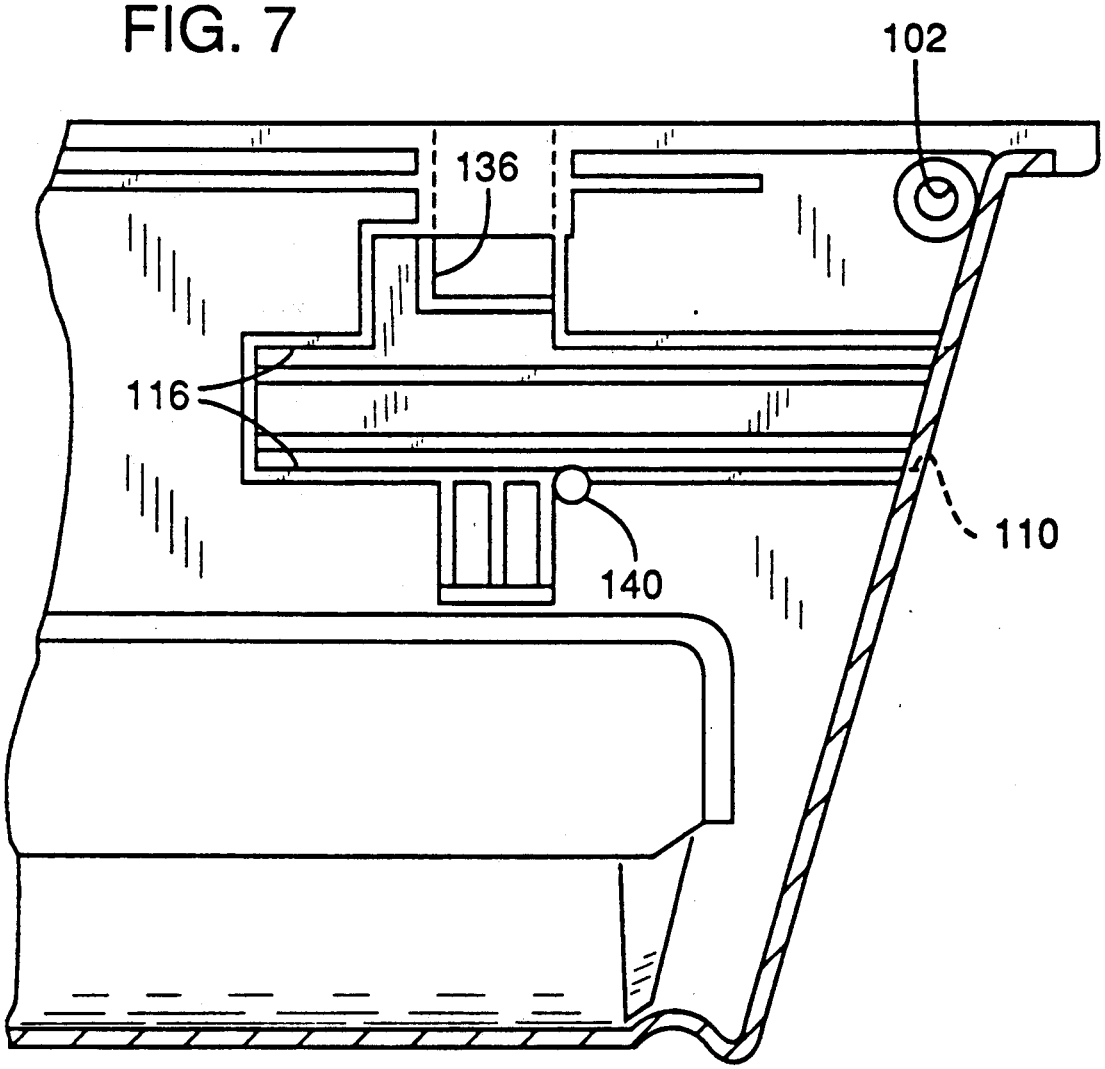

FIG. 7 is a view, similar to FIG. 5, but showing the latch mechanism parts removed from the panel.

Figure 1:
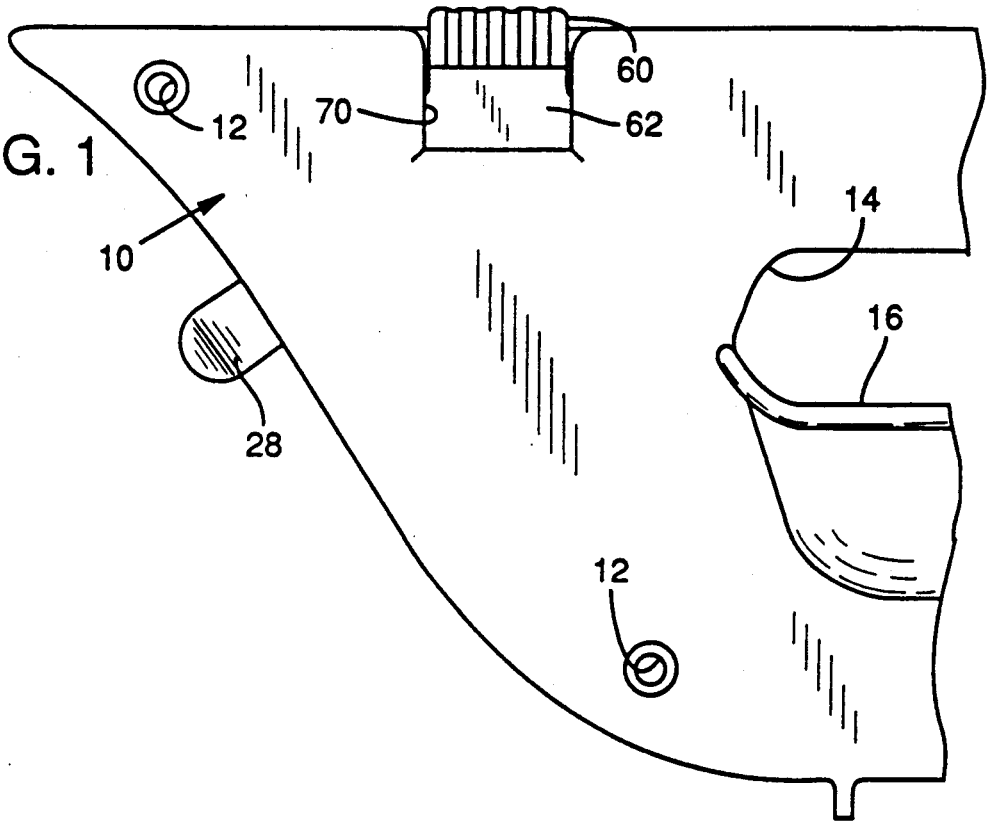
FIG. 1 is an elevational view showing portions of the inwardly side of an inner panel of a toy vehicle door, and protruding portions of latch mechanism supported on the panel of the door.
Figure 3:
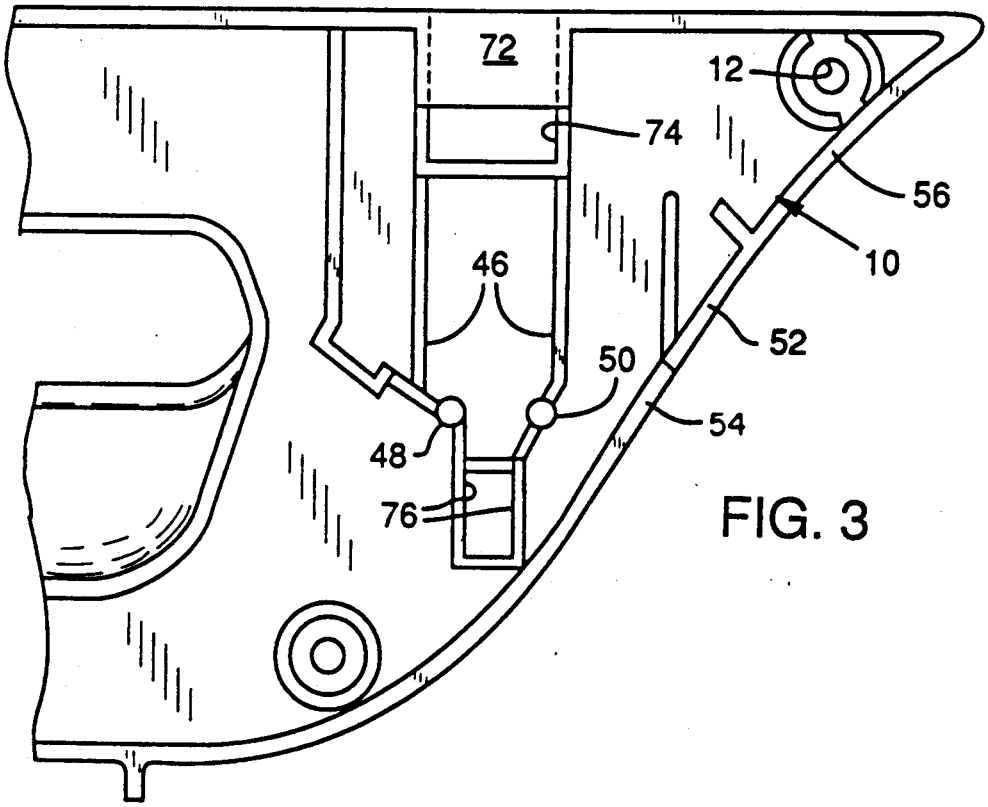
FIG. 3 is a view similar to FIG. 2 but showing the door panel with the parts of the latch mechanism removed.

Referring now to the drawings and more particularly to FIGS. 1, 2, and 3, illustrated at 10 is the inner panel of a toy vehicle door. The side of the panel which faces the viewer in FIG. 1 is the side which faces inwardly on the vehicle door and the side facing the viewer in FIGS. 2 and 3 is the side facing outwardly. To complete the door, an outer panel (not shown) is secured to the inner panel, utilizing suitable fasteners passing through ports indicated at 12. Ordinarily, it is convenient to prepare the inner panel, as well as the outer panel which has not been illustrated, from molded plastic.

The left portion of inner panel 10 as illustrated in FIG. 1 is that portion which swings in an arc to open and close the door opening of the vehicle. Providing for this pivotal movement is the usual hinge structure (not illustrated) which would support the right extremity of the door panel. The panel is provided with an opening 14 and beneath this opening and as an integral part of the panel a molded skirt 16 which the occupant of the vehicle may use in gripping the door to swing it to a closed position.

A latch mechanism designated generally at 20 supported on panel 10 is provided to latch the door in its closed position. The latch mechanism principally comprises two moving parts, namely, a trigger element designated generally at 22 and a striker element designated generally at 24.

Striker element 24 may be formed as an integral plastic piece. It has a fan-shaped body portion 26 and protruding outwardly from this body portion (to the right as illustrated in FIG. 2), a latching end portion 28. Strengthening the striker element is ridge structure 30 which extends outwardly toward the viewer from the plane of the body portion 26 in FIG. 2. This ridge structure also extends about end portion 28. Also extending out from body portion 26 and integral with the body portion is cylinder 32. Finally, a cam follower portion 34 and a spring seating extension 36, both joined to a lug 38 and formed as an integral part of portion 26, are provided at the left of portion 26.

As probably best illustrated in FIG. 3, inner panel 10 includes ridge structure 46 formed as an integral part of the panel and projecting outwardly from the plane of the panel. It also includes a pair of posts 48, 50 also formed as an integral part of the panel. Along an edge of the panel an opening 52 is defined between ridge segments 54, 56 of ridge structure 46.

Striker element 24 is mounted with its cylinder 36 on post 50 and with the element pivotable about the post. The end portion 28 of the striker element extends through opening 52. Pivotal movement is in a plane which substantially parallels the plane of panel 10.

Trigger element 22 may also be formed as an integral plastic piece. The element includes a knob portion 60 at its upper end and this is joined through a leg expanse 62 with a cam portion 64. The base of cam portion 64 has a substantially triangular outline, and joins with an elongate guide portion 66.

Panel 10 has a recessed pocket 70 which faces outwardly as viewed in FIG. 1 Forming the back of this pocket, and integral with the panel, is a strip 72. Below this strip is a rectangular opening 74.

The trigger element is mounted with its leg portion 62 extending through opening 74 and thence up the side of the pocket which faces the viewer in FIG. 1. This places knob portion 60 on one side of the panel or toward the viewer as shown in FIG. I, and the remainder of the trigger element on the opposite side of the panel and slidably supported on ridge structure 46. The guide portion 66 at the end of the trigger element is guided in pocket 76 defined by the ridge structure. What has been described is a mounting for the trigger element, whereby the same is moveable up and down, between a lowered advanced position and a raised return position. The raised position is shown in Figs. 1 and 2. With element 22 in its lowered position, the base of portion 66 drops to the bottom of pocket 76.

It will be noted that with the trigger element and striker element mounted, the trigger element extends downwardly and over the side of the striker element which faces the viewer in FIG. 2. A post 48 has been earlier described. A retainer ring 80 overlying portion 66 of the trigger element is force fit on post 48. The ring serves to retain the trigger element in its guided position on inner panel 10. With the trigger element retained, and since it overlies the striker element, the striker element is also retained.

Earlier a seating extension 36 was described. A coil spring 82 seated on this extension serves to bias the striking element in a clockwise direction as such appears in FIG. 2. Portion 34, by engaging cam edge 90 of cam portion 64, limits movement of the striker element in a clockwise direction.

The operation of the latch mechanism should be obvious. Coil spring 82 biases the striking element to its extended position, which is the latching position, where end portion 28 seats within an appropriate notch or behind an appropriate ridge which functions to hold a door containing the latch mechanism in a closed position. To produce release of the door, knob 60 is manually depressed. This causes the trigger element to move downwardly. Cam edge 90 moves across portion 34 producing counterclockwise swiveling of the striker element and movement of latching end portion 28 to a release position. With release of the trigger element the striker element is again urged to its extended position with upward movement of the trigger element.

FIGS. 5 and 6 illustrate a modification of the invention. In this form of the invention the inner door panel 100 is provided with ports 102 for attaching through fasteners and overlying outer panel.

The striker element 106 of the latch mechanism is an elongate element mounted for reciprocal movement in a linear path. An opening 110 is defined through which the latching end portion of the striker element projects.

Element 106 is guided for movement back and forth in a lineal path by ridge structure 116 forming part of the inner door panel. Biasing movement of the striker element outwardly is a coil spring 118 which sits within a space bounded by ridge structure 116 and on a seating extension 120 of the striker element.

Movement of the striker element is produced by up and down movement of trigger element 122. The trigger element includes a knob 124 at its top end joining with a leg expanse 126 with a cam portion 128.

It will be noted that the striker element includes a channel 130 extending down and passing through its interior. This channel is bounded along one side by a sloping cam-engaged surface 132. Cam surface 134 of the cam element rides against cam-engaged surface 132.

As in the first embodiment of the invention, leg expanse 126 passes through an opening 136 and is guided by ridge guide structure 46 in a pocket 76. Knob 124 appears on the opposite side of the panel from the remainder of the trigger element.

The trigger element in this instance is retained in place by reason of its passing through channel 130 provided in the striker element. The striker element is retained in place by retainer ring 138 which overlies the striker element and which is press fit on post 140 integral with the door panel.

As in the first modification of the invention, depressing of knob 124 functions to shift the striker element to the left against the biasing of the spring, in this instance, spring 118. With release of the knob the spring urges the striker outwardly to an extended position.

In both forms of the invention described, there are principally two moving parts, i.e., the striker element and the trigger element. The parts are suitable for manufacturing as molded plastic articles. The parts are movably mounted on the 10 panel by post and guide structure which may be an integral part of the panel. One of the parts is retained in place by the other part, and this other part is retained in place by the press fit retainer ring which overlies it.

While an embodiment of the invention has been described, it should be obvious that modifications and variations are possible without departing from the invention. It is desired to cover all such modifications as would be apparent to one skilled in the art.

I claim:

1. A latch mechanism comprising:

a panel having a guide structure carried thereon, a manually depressible trigger element mounted on said guide structure for reciprocal movement between advanced and returned positions, a striker element with a latching end portion mounted adjacent the trigger element for reciprocal movement on said guide structure between an extended latching position and a retracted unlatching position, biasing means operatively connected to the striker element urging movement of the striker element to its extended latching position, the trigger element including a cam portion and the striker element including a portion engaged by the cam portion, and the cam portion operating on the cam-engaged portion with movement of the trigger element to its advanced position to produce movement of the striker element to its retracted position against the urging of said biasing means, wherein one of said elements includes a construction whereby it serves to retain the other element on said guide structure, and a post located on said panel, and a retainer carried on said post, said retainer serving to retain said one of said elements on said guide structure.

2. The latch mechanism of claim 1, wherein said one of said elements is said trigger element.

3. The latch mechanism of claim 1, wherein said one of said elements is the striker element.

4. Latch mechanism comprising:

an upright panel, having intersecting channels formed thereon, said intersecting channels being formed by a guide structure, a trigger element and means on said panel mounting the trigger element for vertical movement on said guide structure between a raised returned position and a lowered advanced position, a striker element with a latching end portion and means on the panel mounting the striker element for guided movement on said guide structure between an extended latching position which said end portion is exposed beyond said panel and a retracted unlatching position, said striker element being mounted adjacent said trigger element and said striker element on moving to its extended latching position moving laterally to one side of the trigger element, biasing means interposed between the striker element and said panel urging the striker element to its extended latching position, and a cam portion bounded by a cam surface on said trigger element, said cam surface inclining away from said side of the trigger element including a follower portion engaged by the cam surface, said follower portion when said cam surface moves downwardly operating to move the striker element toward its retracted position against the biasing of said biasing means.

5. The latch mechanism of claim 4, wherein said striker element extends transversely of the trigger element and is mounted for movement in a substantially lineal path, and said striker element includes a chamber extending therethrough, said trigger element being mounted with the base thereof extending through said chamber.

6. The latch mechanism of claim 5, which further comprises a post integral with the panel and a retainer secured on said post retaining the striker element in position.

7. The latch mechanism of claim 4, wherein said trigger element has a top end and a bottom end and includes a knob formed at the top end thereof adapted for finger actuation, said panel includes an opening, and said trigger element extends through said opening to have its bottom end on one side of the panel and its top end with said knob on the opposite side of the panel.

8. The latch mechanism of claim 4, which further includes a post on said panel, and wherein said striker element includes means receiving said post and mounting said striker element for pivotal movement between extended and retracted positions with the panel on one side of the striker element, said trigger element extending downwardly and adjacent said striker element and on the opposite side of said striker element from said panel.

9. The latch mechanism of claim 8, and further including another post on said panel, and a retainer ring gripping said other post retaining the trigger element in place.

* * * * *